US008789517B2

(12) United States Patent
Narita

(10) Patent No.: US 8,789,517 B2
(45) Date of Patent: Jul. 29, 2014

(54) ENGINE INTAKE SYSTEM

(75) Inventor: Hironori Narita, Tokyo (JP)

(73) Assignee: Hino Motors, Ltd., Hino-shi (JP)

( * ) Notice: Subject to any disclaimer, the term of this patent is extended or adjusted under 35 U.S.C. 154(b) by 115 days.

(21) Appl. No.: 13/265,184

(22) PCT Filed: Feb. 24, 2010

(86) PCT No.: PCT/JP2010/001230
§ 371 (c)(1),
(2), (4) Date: Oct. 19, 2011

(87) PCT Pub. No.: WO2010/125724
PCT Pub. Date: Nov. 4, 2010

(65) Prior Publication Data

US 2012/0048247 A1 Mar. 1, 2012

(30) Foreign Application Priority Data

Apr. 30, 2009 (JP) ..... 2009-110842

(51) Int. Cl.
*F01M 13/00* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS

| | | | | |
|---|---|---|---|---|
| 4,205,377 | A * | 5/1980 | Oyama et al. | 701/108 |
| 5,172,670 | A * | 12/1992 | Nemoto | 123/406.46 |
| 6,983,735 | B2 * | 1/2006 | Toyoshima et al. | 123/339.15 |
| 7,509,210 | B2 * | 3/2009 | Tsuda et al. | 701/114 |
| 7,726,288 | B2 * | 6/2010 | Chen | 123/572 |
| 2005/0022795 | A1 * | 2/2005 | Beyer et al. | 123/516 |
| 2006/0243258 | A1 * | 11/2006 | Withrow et al. | 123/559.1 |
| 2011/0023852 | A1 * | 2/2011 | Yamashita | 123/574 |

FOREIGN PATENT DOCUMENTS

| | | |
|---|---|---|
| DE | 102 22 808 A1 | 11/2003 |
| DE | 10 2007 050 087 B3 | 6/2009 |
| JP | 2003 278523 | 10/2003 |
| JP | 2005 273562 | 10/2005 |
| JP | 2007 2838 | 1/2007 |
| JP | 2007-2838 A | 1/2007 |

OTHER PUBLICATIONS

European Search Report Issued Sep. 17, 2012 in Patent Application No. EP 10 76 9426.
International Search Report Issued May 18, 2010 in PCT/JP10/001230 Filed Feb. 24, 2010.

* cited by examiner

*Primary Examiner* — M. McMahon
(74) *Attorney, Agent, or Firm* — Oblon, Spivak, McClelland, Maier & Neustadt, L.L.P.

(57) ABSTRACT

An engine intake system is provided with a controller for calculating an idling intake air quantity on the basis of an air flow rate measured by an airflow meter and determining disconnection of a blow-by gas return tube in a case where a value obtained by subtracting the idling intake air quantity from a stored normal intake air quantity exceeds a threshold.

1 Claim, 3 Drawing Sheets

ENGINE INTAKE SYSTEM

TECHNICAL FIELD

The present invention relates to an engine intake system.

BACKGROUND ART

A gas leaking through a gap of a piston ring into a crankcase during engine compression and explosion strokes is generally called blow-by gas. The blow-by gas, which fills the crankcase and a cylinder head cover communicating therewith, needs to be released outside.

However, the crankcase has therein a crankshaft, a connecting rod and the like which move fast, and the cylinder head cover communicating with the crankcase has therein a rocker arm, a valve and the like which are in work, so that the crankcase and the cylinder head cover are full of oil mist.

Accordingly, mere release of the blow-by gas to the atmosphere results in discharge of also the oil mist mixed with the blow-by gas to outside, leading to increase in engine oil consumption as well as to environmental pollution. For these reasons, a recent diesel engine is also provided with a closed breather which is operated by a negative pressure of an intake system to return the blow-by gas to the intake system and which is capable of collecting and removing the oil mist contained in the blow-by gas, thereby preventing the blow-by gas from being discharged to the atmosphere.

FIG. 1 shows an example of an intake system in a conventional diesel engine. Reference numeral 1 denotes a diesel engine body; 2, a cylinder head cover of the body 1; 3, an intake manifold connected to the body 1; 4, an intake pipe connected to the manifold 3; 5, an air cleaner connected to the pipe 4; and 6, an airflow meter for measuring a flow rate of air flowing through the pipe 4. A blow-by gas vent tube 7 has one end connected to the cylinder head cover 2 and has the other end connected to a closed breather 8 capable of collecting and removing oil mist contained in the blow-by gas. A blow-by gas return tube 9, which returns to the intake pipe 4 the blow-by gas from which oil mist has been collected and removed by the closed breather 8, has one end connected to the closed breather 8 and has the other end with a return port 10 connected to the pipe 4 downstream of the airflow meter 6.

In FIG. 1, reference numeral 11 denotes an oil mist collection tube connected to a bottom of the closed breather 8 to return to an oil pan (not shown) the oil mist collected and removed from the blow-by gas by the breather 8.

In operation of the diesel engine body 1, clean air filtered by the air cleaner 5 is taken into the diesel engine body 1 through the intake pipe 4 and manifold 3. At this time, the closed breather 8 is operated by the negative pressure of the intake pipe 4 to return the blow-by gas to the pipe 4 while the oil mist contained in the blow-by gas is collected and removed, thereby preventing the blow-by gas from being released to the atmosphere, reducing the oil consumption and preventing environmental pollution. Since the return port 10 for return of the blow-by gas by the closed breather 8 to the intake pipe 4 is connected thereto downstream of the airflow meter 6, there is no fear that the oil mist remaining without thoroughly removed from the blow-by gas adheres to a tip of the meter 6, thereby preventing an accuracy of air-flow-rate measurement by the airflow meter 6 from being lowered and enabling fine control of a fuel/air mixing ratio, leading to exhaust gas purification.

The conventional diesel engine shown in FIG. 1 is disclosed, for example, in Patent Literature 1.

CITATION LIST

Patent Literature

[Patent Literature 1] JP2003-278523A

SUMMARY OF INVENTION

Technical Problems

When the cylinder head cover 2 is dismounted for maintenance of the above-mentioned engine, usually the blow-by gas return tube 9 is also removed from the intake pipe 4 which constitutes the intake system. After completion of the maintenance, in the event that the operation is resumed by start of the engine with the cylinder head cover 2 only being restored and with the blow-by gas return tube 9 remaining disconnected, there is no means to detect such disconnection, leaving room for improvement.

From 2010 onwards, there is an obligation under U.S. regulations on automobiles to detect disconnection of the blow-by gas return tube 9 in case of larger vehicles.

In view of the above, the invention has its object to provide an engine intake system capable of reliably detecting disconnection of a blow-by gas return tube and effectively coping with, e.g., forgetting to make connection of the blow-by gas return tube after completion of the maintenance.

Solution to Problems

The invention is directed to an engine intake system comprising a closed breather operated by negative pressure of the intake system to return blow-by gas to the intake system and capable of collecting and removing oil mist contained in the blow-by gas, an airflow meter for measuring a flow rate of air flowing through the intake system, and a blow-by gas return tube through which the blow-by gas is returned by said closed breather to the intake system, said return tube being connected to the intake system downstream of the airflow meter, characterized in that it comprises a controller for calculating an idling intake air quantity on the basis of an air flow rate measured by said airflow meter and determining disconnection of said blow-by gas return tube in a case where a value obtained by subtracting said idling intake air quantity from a stored normal intake air quantity exceeds a threshold.

According to the above means, the following effects can be obtained.

When the cylinder head cover is dismounted for maintenance, usually the blow-by gas return tube is also removed from the intake system. After completion of the maintenance, in the event that an operation is resumed by the start of the engine with the cylinder head cover only being restored and with the blow-by gas return tube remaining disconnected, air is taken in also through a portion of the intake system to which the blow-by gas return tube is to be connected. As a result, the air flow rate measured by the airflow meter will be reduced even if a quantity of air fed to the engine does not change. Thus, the idling intake air quantity calculated by the controller on the basis of the air flow rate measured by the airflow meter will be also reduced, so that the value obtained by subtracting the idling intake air quantity from the stored normal intake air quantity will exceed the threshold, thereby enabling a determination that the blow-by gas return tube remains disconnected.

Advantageous Effects of Invention

According to the engine intake system of the invention, there can be obtained advantageous effects of reliably detecting disconnection of the blow-by gas return tube and of effectively coping with, e.g., forgetting to connect the blow-by gas return tube after completion of maintenance.

DESCRIPTION OF EMBODIMENT

An embodiment of the invention will be described with reference to the accompanying drawings.

Figure 1:
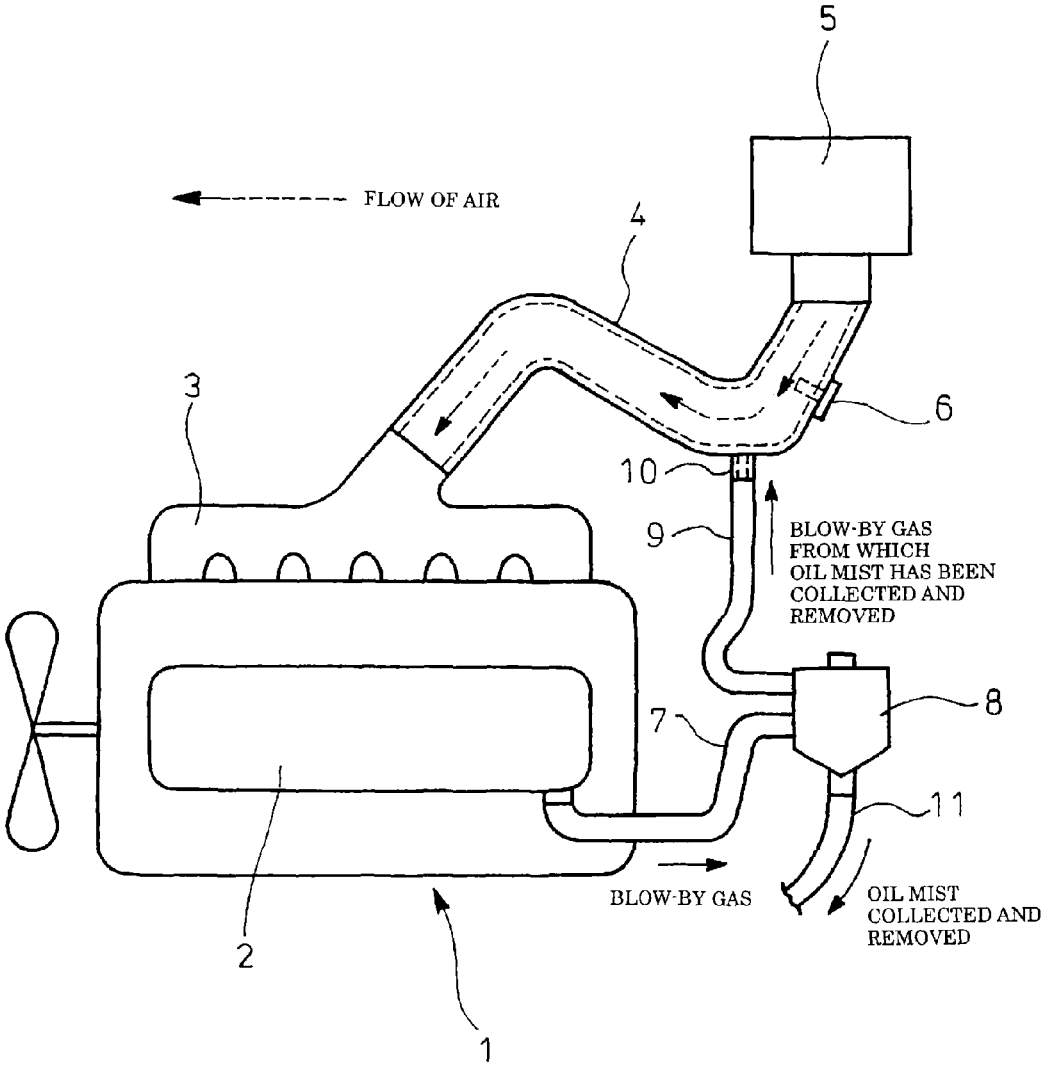
FIG. 1 Background Art
FIG. 1 is a schematic configuration diagram of a conventional example.
Figure 2:
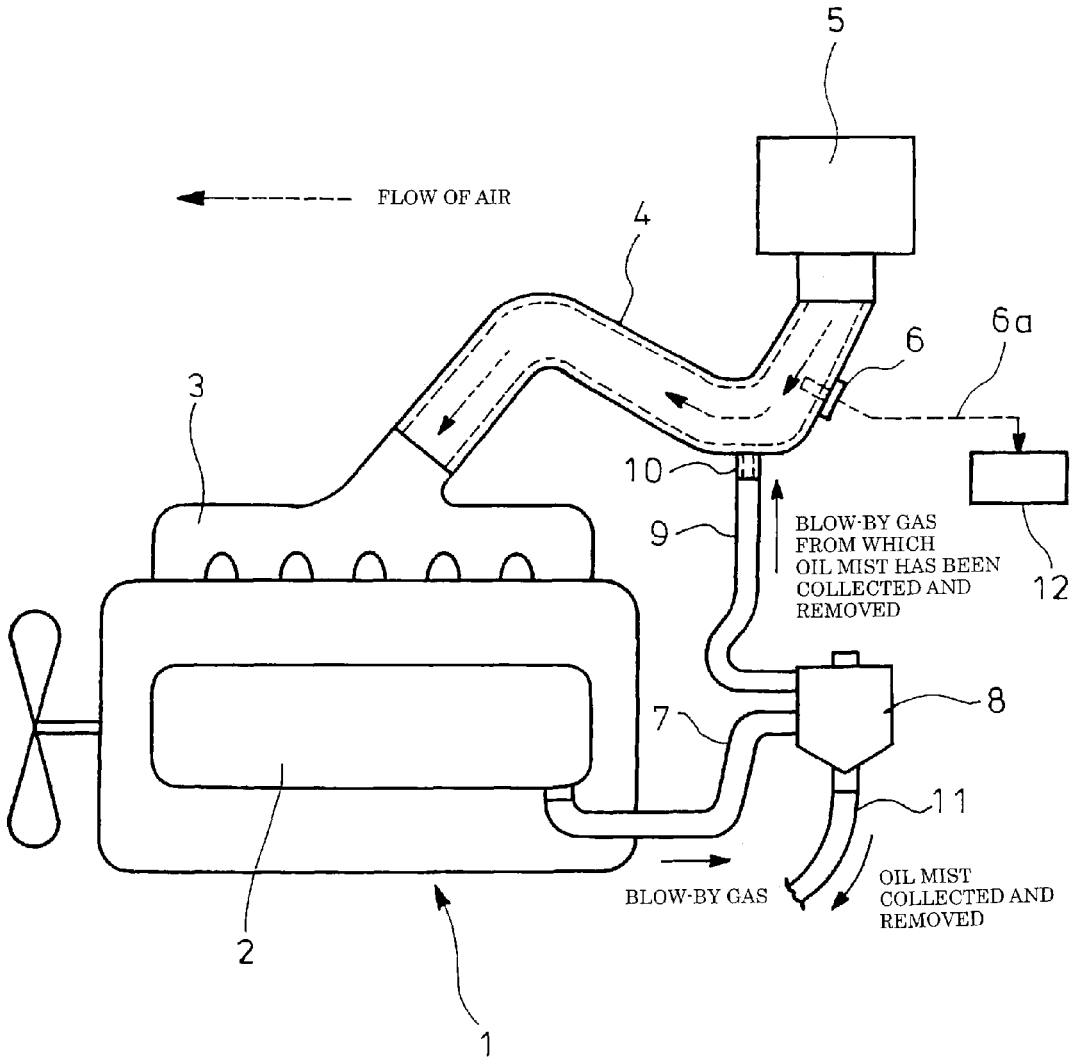
FIG. 2 is a schematic configuration diagram of an embodiment of the invention.
Figure 3:
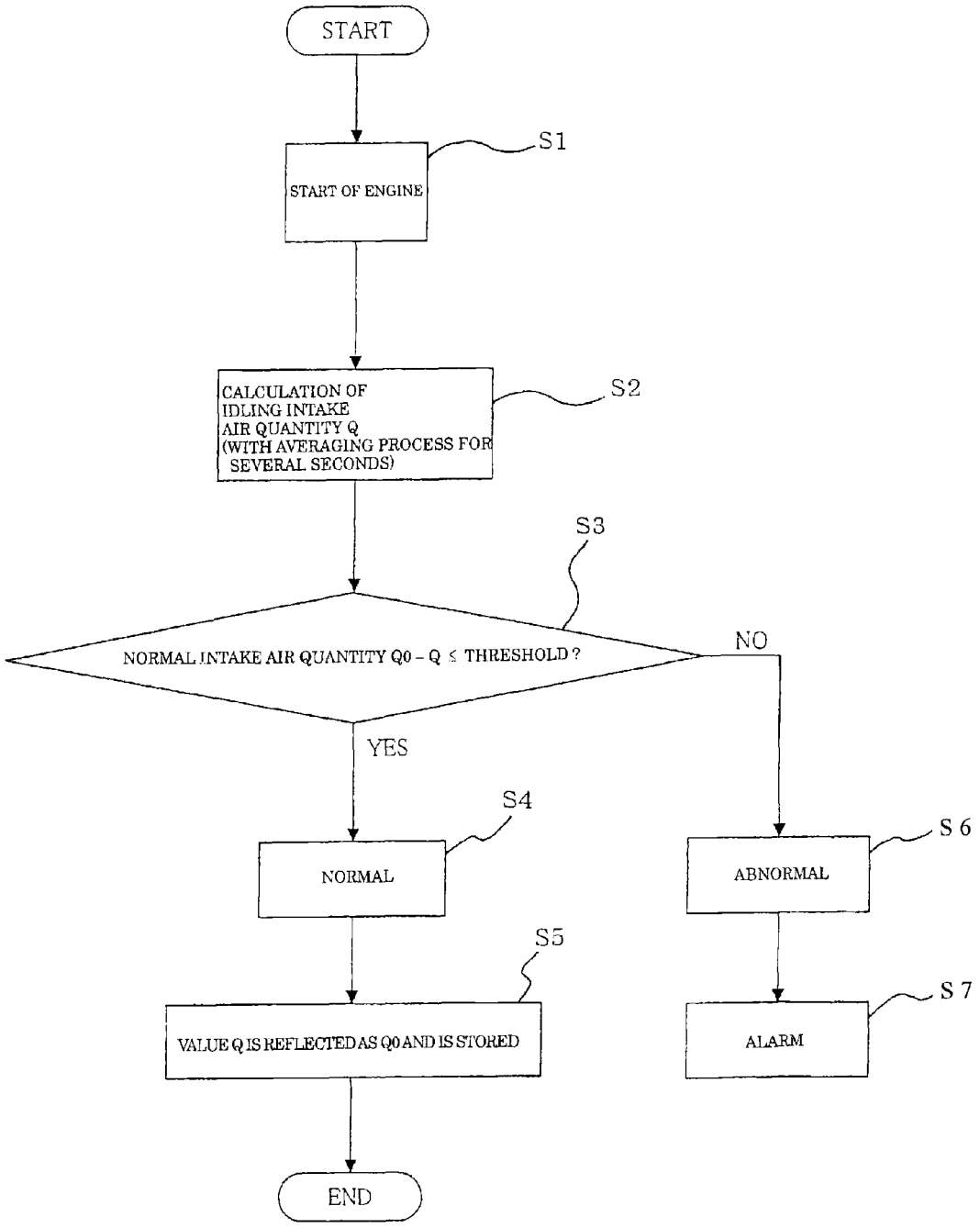
FIG. 3 is a flowchart showing the flow of control in the embodiment of the invention.

FIGS. 2 and 3 show the embodiment of the invention in which equivalents to those shown in FIG. 1 are represented by the same reference numerals. The embodiment has a basic configuration similar to that of the conventional example and resides as shown in FIGS. 2 and 3 in the provision of a controller 12 which calculates an idling intake air quantity Q on the basis of an air flow rate 6*a* measured by an airflow meter 6 and which determines disconnection of the blow-by return tube 9 in a case where a value (Q0−Q) obtained by subtracting the idling intake air quantity Q from a stored normal intake air quantity Q0.

In the embodiment, the controller 12 provides controls as shown in FIG. 3. At step S1, start of the diesel engine body 1 is recognized. At step S2, an idling intake air quantity Q is calculated through an averaging process for several seconds on the basis of an air flow rate 6*a* measured by the airflow meter 6. At step 3, whether a value (Q0−Q) obtained by subtracting the idling intake air quantity Q from a stored normal intake air quantity Q0 exceeds a threshold or not is determined. When the value (Q0−Q) does not exceed the threshold, i.e., when $$Q0-Q \leq \text{threshold}$$

is affirmed, it goes to step 4 with being determined normal. At next step 5, a process of storing the normal intake air flow quantity Q0 reflecting the idling intake air quantity Q. Subsequently, the operation of the diesel engine body 1 is stopped and the stored normal intake air quantity Q0 is used after the next start of the diesel engine body 1. A previously stored initial set value is used as the normal intake air quantity Q0 after the first start of the diesel engine body 1.

On the contrary, when the value (Q0−Q) does exceed the threshold in the determination of whether the value (Q0−Q) obtained by subtracting the idling intake air quantity Q from the normal intake air quantity Q0 stored therein exceeds the threshold at step S3, i.e., when $$Q0-Q \leq \text{threshold}$$

is negated (when Q0−Q>threshold is affirmed), then it goes to step S6 with being determined abnormal. Then, an alarm is issued at step S7 to notify the operator of the abnormality.

Then, an operation of the above embodiment will be described.

When the diesel engine body 1 is first started (see step S1 of FIG. 3), the idling intake air quantity Q is calculated in the controller 12 through an averaging process for several seconds based on the air flow rate 6*a* measured by the airflow meter 6 (see step S2 of FIG. 3); determination is made of whether the value (Q0−Q) obtained by subtracting the idling intake air quantity Q from an normal intake air quantity Q0 as an initial set value preliminarily stored therein exceed the threshold (see step S3 of FIG. 3); and, if the value (Q0−Q) does not exceed the threshold, i.e., if $$Q0-Q \leq \text{threshold}$$

is affirmed (see "YES" of step S3 of FIG. 3); then determination is made as being normal (see step S4 of FIG. 3); and a process is performed of storing the normal intake air flow quantity Q0 reflecting the idling intake air quantity Q (see step S5 of FIG. 3). Subsequently, the operation of the diesel engine body 1 is stopped and the stored normal intake air quantity Q0 is used after the next start of the diesel engine body 1.

On the other hand, when the cylinder head cover 2 is dismounted for maintenance, usually the blow-by gas return tube 9 is also removed from the intake pipe 4 which constitutes the intake system. After completion of the maintenance, in the event that an operation is resumed by the start of the diesel engine body 1 (see step S1 of FIG. 3) with the cylinder head cover 2 only being restored and with the blow-by gas return tube remaining disconnected, air is taken in also through a portion of the intake pipe 4 to which the blow-by gas return tube 9 is to be connected.

As a result, the air flow rate 6*a* measured by the airflow meter 6 is reduced even if a quantity of air fed to the diesel engine body 1 does not change. Thus, the idling intake air quantity Q calculated by the controller 12 through an averaging process for several seconds (see step S2 of FIG. 3) on the basis of the air flow rate 6*a* measured by the airflow meter 6 is also reduced, so that the value (Q0−Q) obtained by subtracting the idling intake air quantity Q from the normal intake air quantity Q0 stored therein exceeds the threshold, i.e., $$Q0-Q \leq \text{threshold}$$

is negated (Q0−Q>threshold is affirmed) (see NO of step S3 of FIG. 3), determination is made as being abnormal (see step S6 of FIG. 3), and an alarm is issued (see step S7 of FIG. 3) to notify the operator of the abnormality, thereby enabling determination of disconnection of the blow-by gas return tube 9.

Thus, it becomes feasible to reliably detect disconnection of the blow-by gas return tube 9 and to effectively cope with, e.g., forgetting to connect the blow-by gas return tube after completion of maintenance.

It is to be understood that an engine intake system of the invention is not limited to the above embodiment and that various changes and modifications may be made without departing from the scope of the invention.

REFERENCE SIGNS LIST

1 diesel engine body
2 cylinder head cover
4 intake tube (intake system)
5 air cleaner
6 airflow meter
6*a* air flow rate
7 blow-by gas vent tube
8 closed breather
9 blow-by gas return tube
10 return port
11 oil mist collection tube
12 controller
Q idling intake air quantity
Q0 normal intake air quantity

The invention claimed is:

1. An engine intake system comprising:

a closed breather operated by negative pressure of the intake system to return blow-by gas to the intake system and capable of collecting and removing oil mist contained in the blow-by gas;

an airflow meter for measuring a flow rate of air flowing through the intake system;

a blow-by gas return tube through which the blow-by gas is returned by said closed breather to the intake system, said return tube being connected to the intake system downstream of the airflow meter; and a controller configured to calculate an idling intake air quantity through an averaging process for several seconds on the basis of an air flow rate measured by said airflow meter and determine disconnection of said blow-by gas return tube in a case where a value obtained by subtracting said idling intake air quantity from a stored normal intake air quantity exceeds a threshold, and in a case where said value does not exceed the threshold, determine normality to store the normal intake air flow quantity reflecting said idling intake air quantity and subsequently stop an operation of a diesel engine body, said stored normal intake air quantity being used after a next start of the diesel engine body.

* * * * *